US009138696B2

(12) United States Patent
Bhopte et al.

(10) Patent No.: US 9,138,696 B2
(45) Date of Patent: Sep. 22, 2015

(54) HONEYCOMB BODY U-BEND MIXERS

(75) Inventors: Siddharth Bhopte, Chandler, AR (US); James Scott Sutherland, Corning, NY (US)

(73) Assignee: CORNING INCORPORATED, Corning, NY (US)

( * ) Notice: Subject to any disclaimer, the term of this patent is extended or adjusted under 35 U.S.C. 154(b) by 554 days.

(21) Appl. No.: 13/503,703

(22) PCT Filed: Nov. 23, 2010

(86) PCT No.: PCT/US2010/057725

§ 371 (c)(1), (2), (4) Date: Apr. 24, 2012

(87) PCT Pub. No.: WO2011/066247

PCT Pub. Date: Jun. 3, 2011

(65) Prior Publication Data

US 2012/0219752 A1 Aug. 30, 2012

Related U.S. Application Data

(60) Provisional application No. 61/265,354, filed on Nov. 30, 2009.

(51) Int. Cl.

| | |
|---|---|
| ***B01F 5/00*** | (2006.01) |
| ***F28F 7/00*** | (2006.01) |
| ***B01F 5/06*** | (2006.01) |
| ***F28F 7/02*** | (2006.01) |
| ***F28F 21/04*** | (2006.01) |

(52) U.S. Cl.

CPC . *B01F 5/064* (2013.01); *F28F 7/02* (2013.01); *F28F 21/04* (2013.01); *F28F 2220/00* (2013.01); *Y10T 428/24157* (2015.01)

(58) Field of Classification Search

None

See application file for complete search history.

(56) References Cited

U.S. PATENT DOCUMENTS

| | | | | |
|---|---|---|---|---|
| 3,881,701 | A | 5/1975 | Schoenman et al. | 259/4 |
| 3,965,975 | A * | 6/1976 | Edmundson | 366/336 |
| 3,997,632 | A | 12/1976 | Kloss | 261/103 |
| 4,136,675 | A | 1/1979 | Karasick | 126/271 |
| 4,390,281 | A | 6/1983 | Scriminger | 366/3 |
| 4,971,450 | A | 11/1990 | Gerich | 366/340 |
| 4,987,034 | A | 1/1991 | Hitachi et al. | 428/593 |
| 5,094,788 | A | 3/1992 | Schrenk et al. | 264/171 |

(Continued)

FOREIGN PATENT DOCUMENTS

| | | | |
|---|---|---|---|
| EP | 2098285(A1) | 9/2009 | |
| GB | 1291297 | 7/1970 | F16K 11/06 |

(Continued)

*Primary Examiner* — David Sample
*Assistant Examiner* — Nicholas W Jordan
(74) *Attorney, Agent, or Firm* — Gregory V. Bean

(57) ABSTRACT

A honeycomb extrusion body (20) is provided having multiple cells (22) extending along a common direction from a first end (26) of the body to a second end (28) and separated by cell walls, the body having at least one fluid path (32) defined within a plurality of said cells, the fluid path having including at least one direction—reversing bend (14) at which the path on entering the bend includes two or more separate cells (22A) and at which the path on leaving the bend includes only one cell (22B). The body desirably includes first and second input ports, the first fluid input port being in fluid communication with one of the two or more separate cells and the second fluid input port being in fluid communication with another of the two or more separate cells.

8 Claims, 4 Drawing Sheets

(56) References Cited

U.S. PATENT DOCUMENTS

| | | | | |
|---|---|---|---|---|
| 5,094,793 | A | 3/1992 | Schrenk et al. | 264/171 |
| 5,176,925 | A | 1/1993 | Weber et al. | 425/191 |
| 5,320,428 | A | 6/1994 | Streiff | 366/337 |
| 5,489,153 | A | 2/1996 | Berner et al. | 366/337 |
| 5,793,831 | A * | 8/1998 | Tsiklauri et al. | 366/167.1 |
| 5,803,600 | A | 9/1998 | Schubert et al. | 366/144 |
| 6,082,891 | A | 7/2000 | Schubert et al. | 366/338 |
| 6,117,578 | A * | 9/2000 | Lesieur | 422/200 |
| 6,264,900 | B1 | 7/2001 | Schubert et al. | 422/224 |
| 6,305,834 | B1 | 10/2001 | Schubert et al. | 366/144 |
| 6,321,998 | B1 | 11/2001 | Schubert et al. | 239/8 |
| 6,444,179 | B1 | 9/2002 | Sederquist | 422/191 |
| 6,802,640 | B2 | 10/2004 | Schubert et al. | 366/181.6 |
| 6,942,792 | B2 | 9/2005 | Aso | 210/198.2 |
| 6,982,064 | B1 | 1/2006 | Ehrfeld et al. | 422/130 |
| 7,220,506 | B2 | 5/2007 | Cochran et al. | 429/130 |
| 7,223,348 | B1 | 5/2007 | Seregin et al. | 210/802 |
| 7,276,215 | B2 | 10/2007 | Muller | 422/224 |
| 7,485,266 | B2 | 2/2009 | Ito et al. | 422/224 |
| 2002/0081254 | A1 * | 6/2002 | Boger | 422/222 |
| 2002/0097633 | A1 | 7/2002 | O'Connor et al. | 366/336 |
| 2003/0050510 | A1 | 3/2003 | Welp et al. | 564/423 |
| 2003/0123322 | A1 | 7/2003 | Chung et al. | 366/165.1 |
| 2004/0130967 | A1 | 7/2004 | Wolf et al. | 366/340 |
| 2004/0252584 | A1 * | 12/2004 | Ji et al. | 366/341 |
| 2005/0213425 | A1 | 9/2005 | Wang et al. | 366/150.1 |
| 2006/0087917 | A1 | 4/2006 | Ehrfeld et al. | 366/340 |
| 2007/0177458 | A1 | 8/2007 | Meiners et al. | 366/336 |
| 2009/0009526 | A1 | 1/2009 | Rice et al. | 345/589 |
| 2010/0135873 | A1 | 6/2010 | Sutherland | 422/218 |
| 2010/0143215 | A1 | 6/2010 | Caze et al. | 422/198 |

FOREIGN PATENT DOCUMENTS

| | | | |
|---|---|---|---|
| WO | 93/02960 | 2/1993 | C01B 15/023 |
| WO | 2008/121390 | 10/2008 | B01J 19/24 |

* cited by examiner

HONEYCOMB BODY U-BEND MIXERS

This application claims the benefit of priority under 35 USC 119(e) of U.S. Provisional Application Ser. No. 61/265,354 filed on Nov. 30, 2009.

BACKGROUND

The disclosure relates to honeycomb extrusion body devices, and more particularly to honeycomb extrusion body devices useful for one or more of heat exchange, mixing, and similar processes, and particularly for mixing.

SUMMARY

The present inventors and/or their colleagues have previously developed processes for forming serpentine channels within a honeycomb extrusion body and devices using such channels beneficially for various fluid processing needs. Generally in such devices, with reference to prior at FIGS. 5 and 6, a honeycomb extrusion body 20 as shown in FIG. 5 includes cells 22 extending from a first end 26 to a second end 28 of the body 20 along a common direction D. Plugs or a sealing material 46 is used to close off a plurality 34 of the cells 22. A serpentine fluid passage 32 may be formed within the plurality 34 of cells closed off by the plugs or sealing material 46. Access to the fluid path 32 may be through an end face of the body 20 as in FIG. 5 or through openings 31 in flats 33 machined on side faces of the body 20 as in FIG. 6. The resulting device 12 may be used as a reactor and/or a heat exchanger, for example, by flowing reactants or fluids to be heated or cooled along the fluid path 32, while flowing temperature control fluid along the cells 30 not closed off. The pattern of the closed off cells and the path 32 they contain, when viewed parallel to direction D, may take various forms, such as the straight path of FIG. 5 or the serpentine one of FIG. 6.

Some details of how plugs or seals 46 help form the path 32 are shown in the cross-sectional views of prior art FIGS. 7 and 8. In these figures may be seen that selectively lowering walls of some of the cells 34 of the honeycomb body 20 allows U-bends 14 to be formed along the path 32, joining adjacent cells of the body 20 to each other in a serpentine fluid path 32.

The present inventors have recognized that it would be desirable to improve the utility of the honeycomb extrusion body devices for any combination of heat exchange and mixing and relating processes, but particularly for mixing, while maintaining ease of fabrication. An embodiment of the present invention addressing this need takes the form of a honeycomb extrusion body having multiple cells extending along a common direction from a first end of the body to a second end and separated by cell walls, the body having at least one fluid path defined within a plurality of said cells, the fluid path having including at least one direction-reversing bend, at which bend the path on entering the bend includes two or more separate cells and at which the path on leaving the bend includes only one cell. The body desirably includes first and second input ports, the first fluid input port being in fluid communication with one of the two or more separate cells and the second fluid input port being in fluid communication with another of the two or more separate cells. The flow path provided in such a body has surprisingly good mixing characteristics while being relatively easy to manufacture.

These features, as well as others described herein below, provide increased heat exchange performance, increased mixing performance, increased preservation of emulsions, and the like, by inducing secondary flows within the cells in which the fluid path lies.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 1:
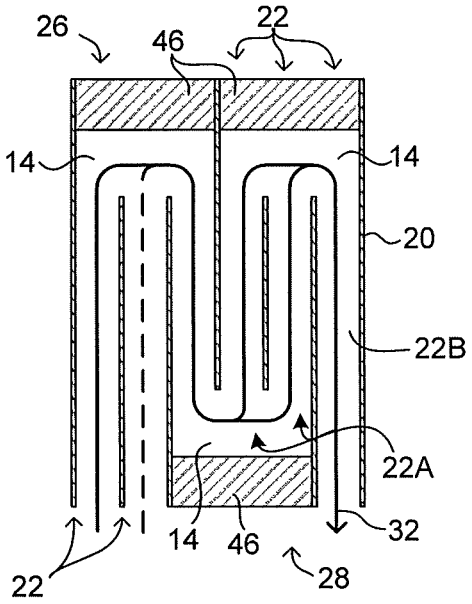
FIG. 1 is a cross-sectional elevation of a portion of a honeycomb body U-bend mixer according to one embodiment of the present disclosure.

Reference will now be made in detail to the present preferred embodiments, examples of which are illustrated in the accompanying drawings. Whenever possible, the same reference numerals will be used throughout the drawings to refer to the same or like parts.

FIG. 1 shows a cross-section of a portion of a honeycomb extrusion body 20 having multiple cells 22 extending along a common direction from first end of the body 26 to a second end 28 and separated by cell walls, the body 20 having at least one fluid path 32 defined within a plurality of said cells, the fluid path 32 including at least one direction-reversing bend 14 or "U-bend" 14, at which bend 14 the path 32 on entering the bend includes two or more separate cells 22A and at which the path 32 on leaving the bend 14 includes only one cell 22B. As may be seen in the embodiment of FIG. 1, the path 32 on entering the bend 14 includes exactly two cells 22A, and multiple bends 14 may be repeated serially along the path 32 if desired. In this case, two bends 14 are arranged serially in along the path 32. Plugs or sealing material 46 help define or form the bends 14. The span of the sealing material or plugs 46 appears relatively large in the cross-section of the figure but is small (one cell wide, typically) in the direction into the plane of the figure, so the sealing material or plugs 46 can provide the needed seal. Flow simulations show good mixing in the stream exiting the bends 14.

Figure 2:
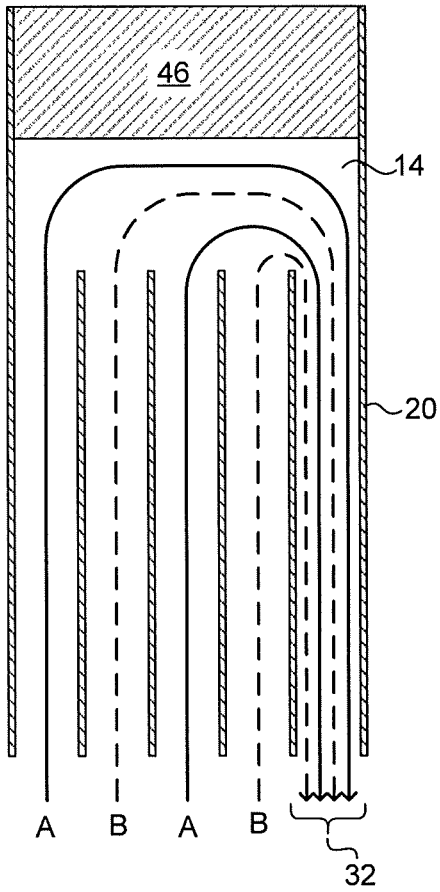
FIG. 2 is a cross-sectional elevation of a portion of a honeycomb body U-bend mixer according to another embodiment of the present disclosure.

Bends 14 of the type disclosed herein can also be used to laminate multiple streams as shown in the cross-section of FIG. 2. Four streams, of two types, A and B, represented by two types of lines in the figure, and desirably by two separate input ports (not shown) are laminated and mixed by passing through the bend 14.

Figure 3:
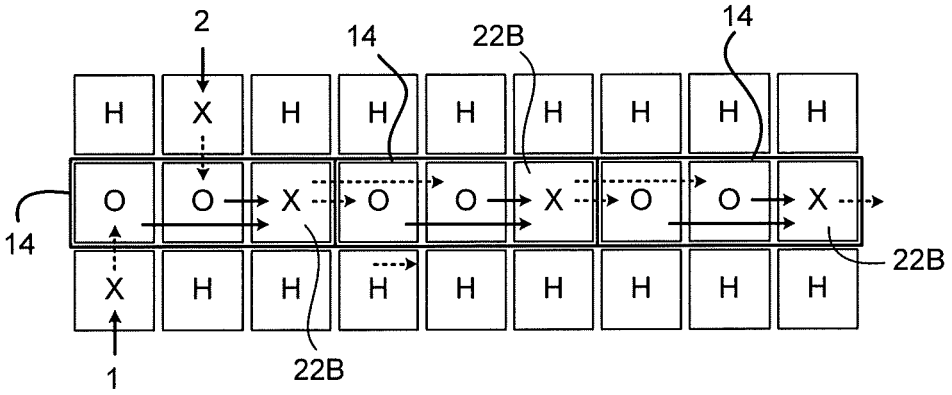
FIG. 3 is a plan view diagram of a portion of a honeycomb body U-mixer embodying a variation of the device of FIG. 1.
Figure 4:
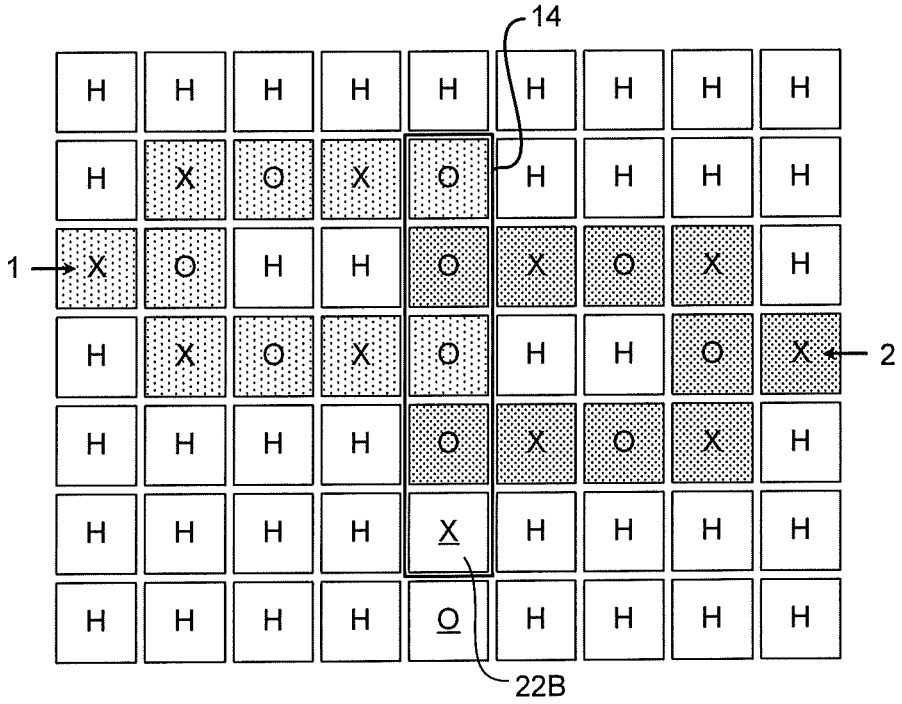
FIG. 4 is a plan view diagram of a portion of a honeycomb body U-mixer embodying a variation of the device of FIG. 2.
Figure 5:
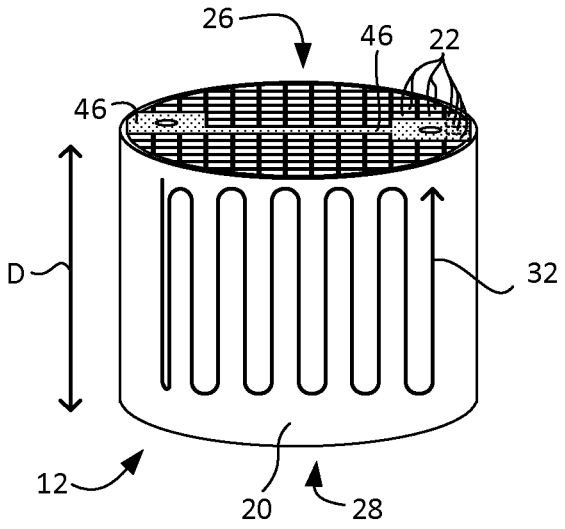
Figure 5 (prior art)
FIGS. 5 and 6 are perspective views of prior art honeycomb body devices developed by the present inventors and/or their colleagues useful in understanding the context of the present disclosure.
Figure 6:
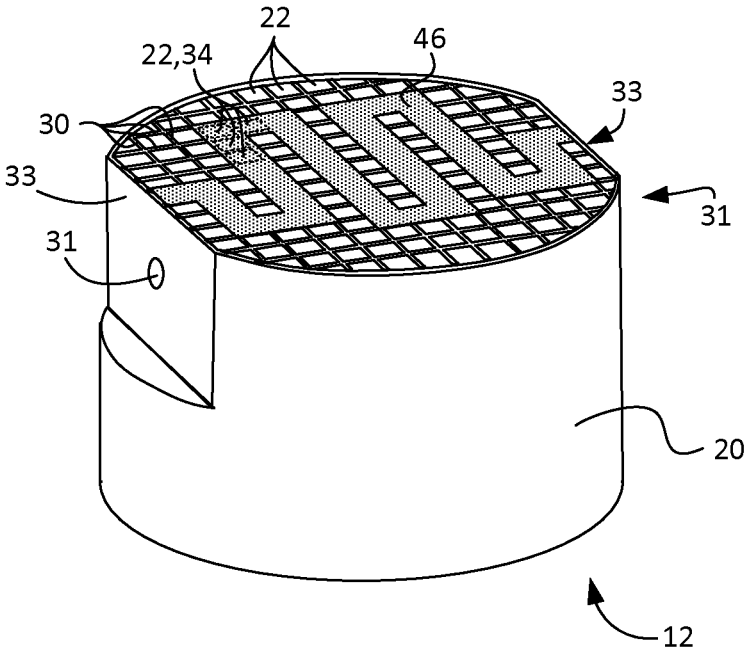
Figure 6 (prior art)
Figure 8:
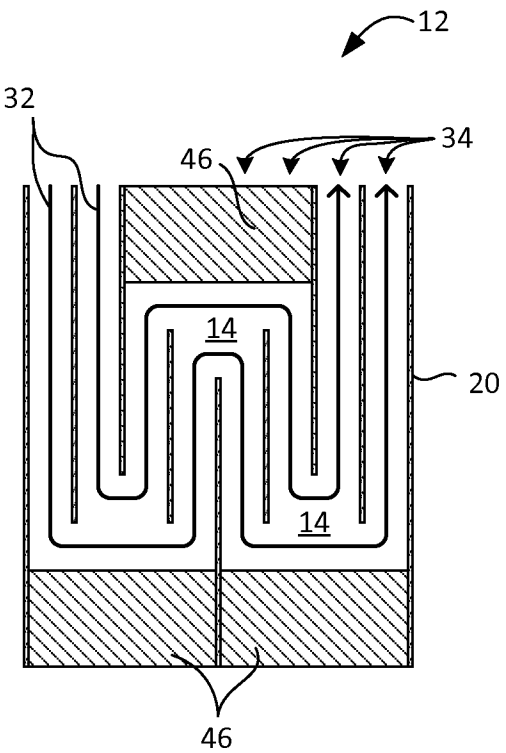
Figure 8 (prior art)
FIGS. 7 and 8 are cross-sectional views of prior art honeycomb body devices developed by the present inventors and/or their colleagues further useful in understanding the context of the present disclosure.

The full utility of these structures can be better appreciated from the plan view diagrams of a portion of a honeycomb body U-bend mixer shown in FIGS. 3 and 4; FIG. 3 corresponds to a variation of the device of FIG. 1, while Figure corresponds to a variation of the device of FIG. 2.

Figure 7:
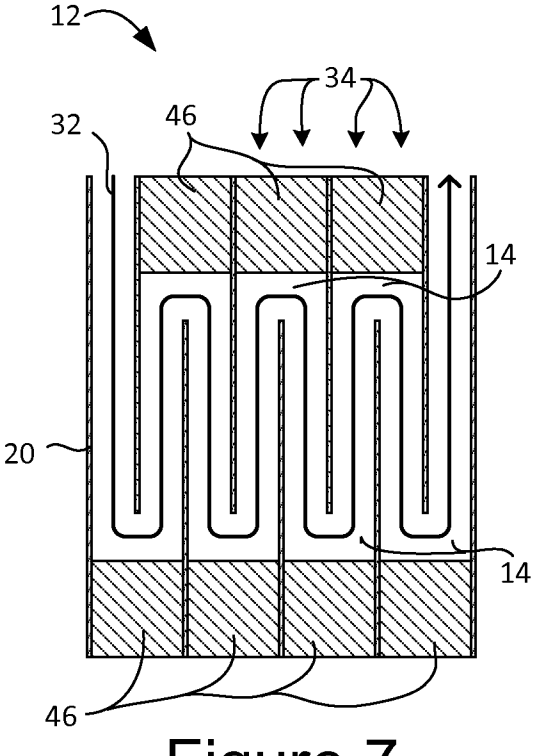
Figure 7 (prior art)

In both FIGS. 3 and 4, two input ports 1 and 2 provide external access allowing separate fluids to be fed for mixing purposes. The "X" marks represent fluid flow away from the viewer, the "0" marks represent fluid flow toward the viewer. U-bends are all of the simple type shown in FIG. 7, except where the heavy-lined rectangles surround the cells. The device of FIG. 3 provides three successive two-into one U-bends 14, while the device of FIG. 4 provides an interleaving mixer having a single 4-into-1 U-bend 14. Heat exchange fluid may be flowed in all of the cells marked "H".

The methods and/or devices disclosed herein provide an easily manufactured two-into-one or many-into-one fluid mixer within the larger structure of a honeycomb-body heat exchanger or heat-exchanging reactor or mixer, with the option of providing a laminating mixer arrangement where multiple subsets of the many streams of a many-to-one mixer are of the same type. The methods and/or devices disclosed herein are generally useful in performing any process that involves mixing, separation, extraction, crystallization, precipitation, or otherwise processing fluids or mixtures of fluids, including multiphase mixtures of fluids—and including fluids or mixtures of fluids including multiphase mixtures of fluids that also contain solids—within a microstructure. The processing may include a physical process, a chemical reaction defined as a process that results in the interconversion of organic, inorganic, or both organic and inorganic species, a biochemical process, or any other form of processing. The following non-limiting list of reactions may be performed with the disclosed methods and/or devices: oxidation; reduction; substitution; elimination; addition; ligand exchange; metal exchange; and ion exchange. More specifically, reactions of any of the following non-limiting list may be performed with the disclosed methods and/or devices: polymerisation; alkylation; dealkylation; nitration; peroxidation; sulfoxidation; epoxidation; ammoxidation; hydrogenation; dehydrogenation; organometallic reactions; precious metal chemistry/homogeneous catalyst reactions; carbonylation; thiocarbonylation; alkoxylation; halogenation; dehydrohalogenation; dehalogenation; hydroformylation; carboxylation; decarboxylation; amination; arylation; peptide coupling; aldol condensation; cyclocondensation; dehydrocyclization; esterification; amidation; heterocyclic synthesis; dehydration; alcoholysis; hydrolysis; ammonolysis; etherification; enzymatic synthesis; ketalization; saponification; isomerisation; quaternization; formylation; phase transfer reactions; silylations; nitrile synthesis; phosphorylation; ozonolysis; azide chemistry; metathesis; hydrosilylation; coupling reactions; and enzymatic reactions.

What is claimed is:

1. A honeycomb extrusion body having multiple cells extending along a common direction from a first end of the body to a second end and separated by cell walls, the body including at least one fluid path defined within a plurality of said cells, the fluid path having including at least one direction-reversing bend at which the path on entering the bend includes two or more separate cells and at which the path on leaving the bend includes only one cell.

2. The honeycomb extrusion body according to claim 1, further comprising first and second input ports, the first fluid input port being in fluid communication with one of the two or more separate cells and the second fluid input port being in fluid communication with another of the two or more separate cells.

3. The honeycomb extrusion body according to claim 1, wherein the two or more separate cells consist of four cells and further comprising first and second input ports, the first fluid input port being in fluid communication with a non-adjacent two of the four cells and the second fluid input port being in fluid communication with the other two of the four cells.

4. The honeycomb extrusion body according to claim 1, wherein the two or more separate cells comprise more than four cells and further comprising first and second input ports, the first fluid input port being in fluid communication with a subset of the more than four cells, the cells of the subset being non-adjacent one another.

5. The honeycomb extrusion body according to claim 1, further comprising multiple U-bends arranged serially along the path, through which U-bends a fluid in the path makes a complete U-turn, and at which U-bends the path, on entering a respective one of the U-bends, includes two or more separate cells, and at which the path, on leaving the respective one of the U-bends, includes only one cell.

6. The honeycomb extrusion body according to claim 5, wherein the two or more separate cells are two cells.

7. The honeycomb extrusion body according to claim 1, wherein the walls of the honeycomb body comprise one or more of ceramic, glass, and glass-ceramic.

8. The honeycomb extrusion body according to claim 7, wherein the honeycomb body comprises an extruded monolithic body.

* * * * *